United States Patent [19]

Pharo

[11] Patent Number: 4,949,530

[45] Date of Patent: Aug. 21, 1990

[54] METHOD FOR FORMING BAG-IN-BAG PACKAGING SYSTEM

[76] Inventor: Daniel A. Pharo, 1901 Avenue of the Stars, Suite 450, Los Angeles, Calif. 90067

[21] Appl. No.: 392,443

[22] Filed: Aug. 11, 1989

Related U.S. Application Data

[62] Division of Ser. No. 089,228, Aug. 25, 1987, Pat. No. 4,872,558.

[51] Int. Cl.[5] ..... B65B 23/00

[52] U.S. Cl. ..... 53/449; 53/472

[58] Field of Search ..... 53/449, 472, 469, 467, 53/452

[56] References Cited

U.S. PATENT DOCUMENTS

| | | | |
|---|---|---|---|
| 2,542,206 | 2/1951 | Nichols | 99/189 |
| 2,895,270 | 7/1959 | Blaess | 53/21 |
| 2,994,424 | 8/1961 | Selby et al. | 206/46 |
| 3,009,498 | 11/1961 | Fohr | 150/9 |
| 3,461,645 | 8/1969 | Synder | 53/112 |
| 3,910,009 | 10/1975 | Canfield | 53/112 b |
| 4,267,684 | 5/1981 | Ambrose | 53/472 |
| 4,434,893 | 3/1984 | Barlow | 206/522 |
| 4,597,244 | 7/1986 | Pharo | 53/434 |
| 4,640,080 | 2/1987 | Wright | 53/472 X |
| 4,793,123 | 12/1988 | Pharo | 53/472 X |

FOREIGN PATENT DOCUMENTS

| | | |
|---|---|---|
| 1603215 | 4/1971 | France . |

*Primary Examiner*—James F. Coan

*Attorney, Agent, or Firm*—Phillips, Moore, Lempio & Finley

[57] ABSTRACT

A packaging system includes an outer bag having an inner bag suspended therein to define an expandable chamber between the bags and one either side of the inner bag. When the chamber is charged with a filler medium, such as pressurized air, the outer bag will inflate to suspend the inner bag at a fixed position therein. The inner bag defines a pocket adapted to receive and retain an article, prepackaged therein.

6 Claims, 5 Drawing Sheets

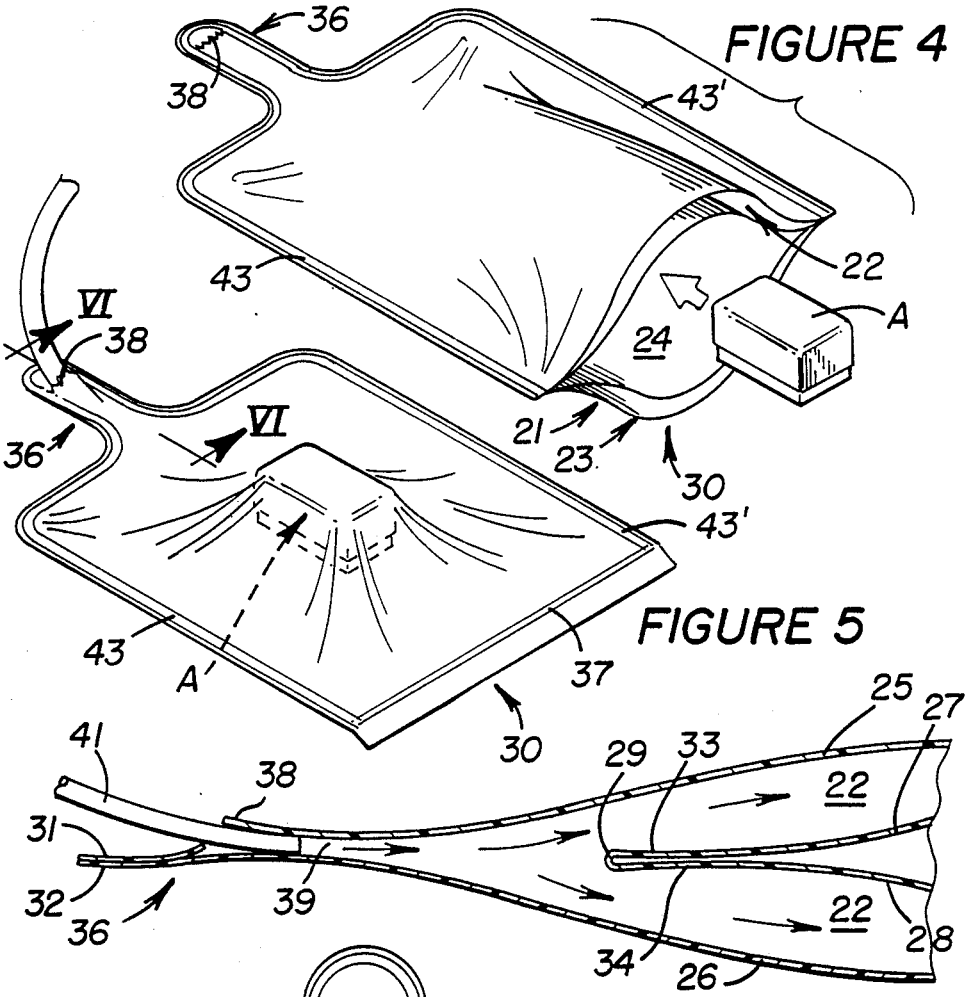
FIGURE 4
FIGURE 5
FIGURE 6
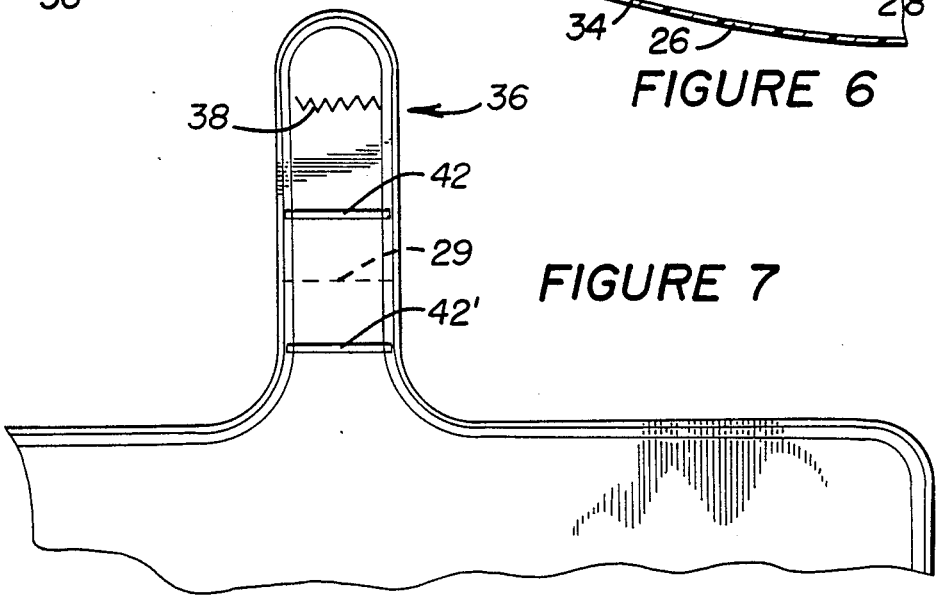
FIGURE 7

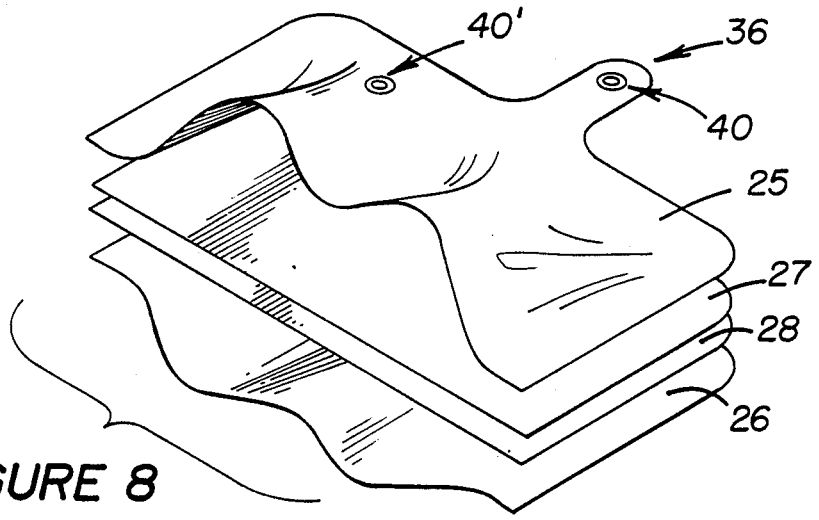
FIGURE 8
FIGURE 9
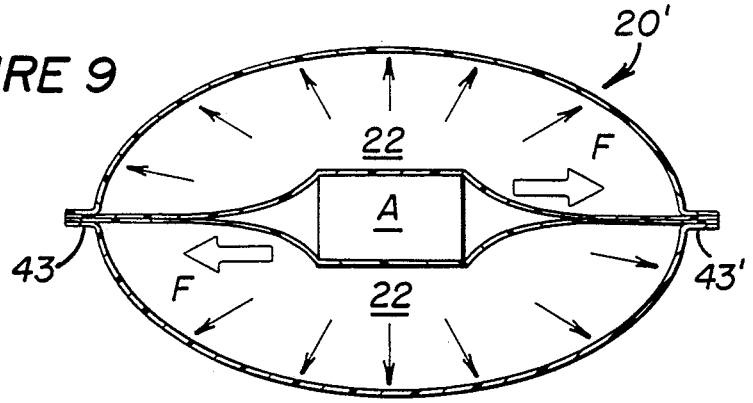
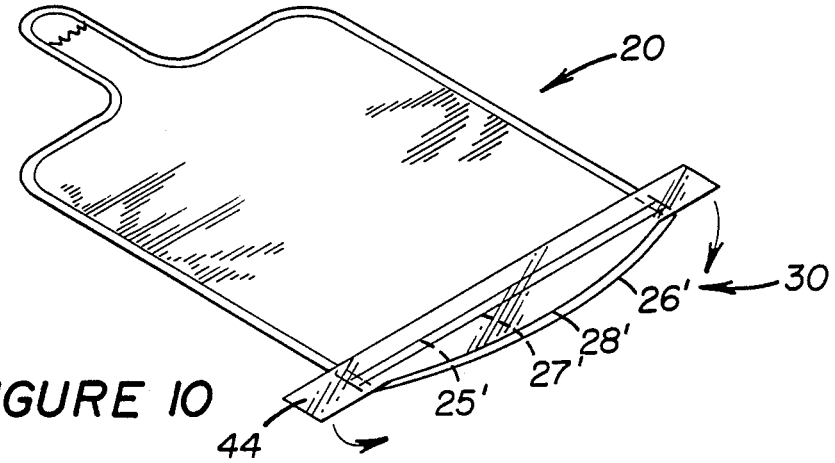
FIGURE 10

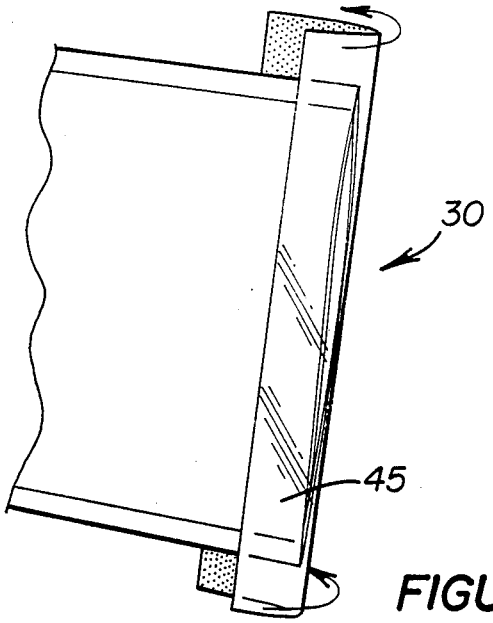
FIGURE 11
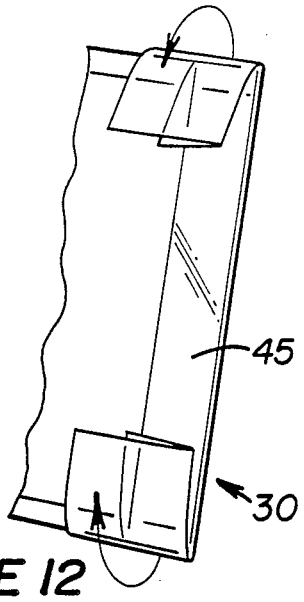
FIGURE 12
FIGURE 13
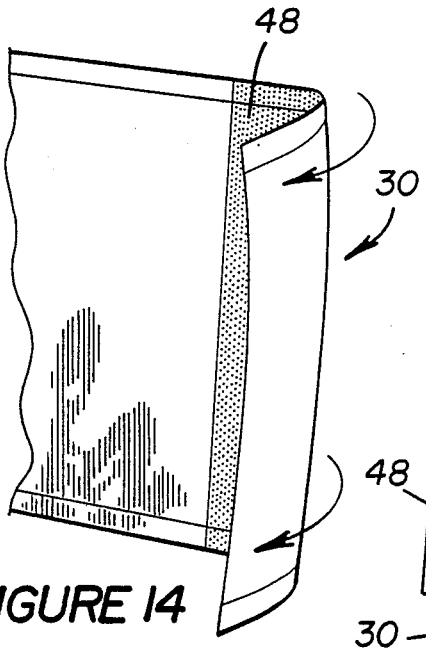
FIGURE 14
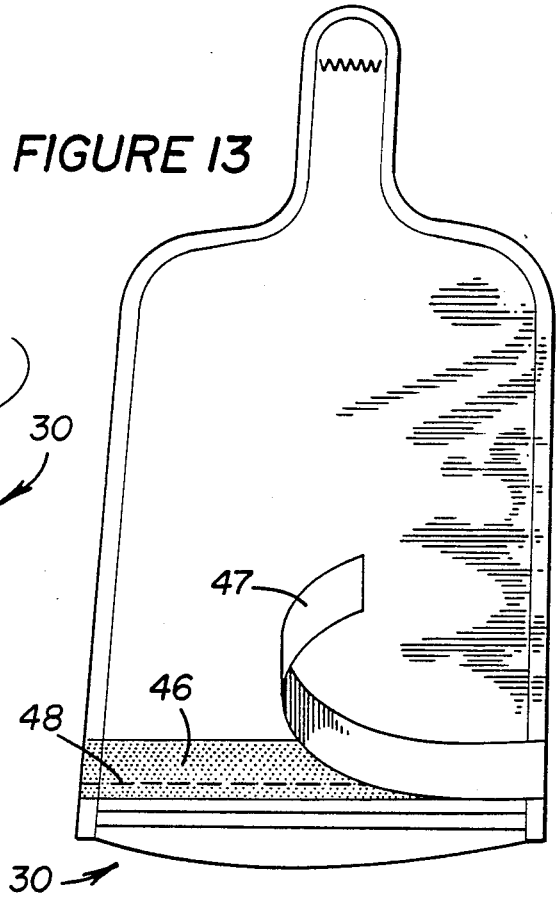

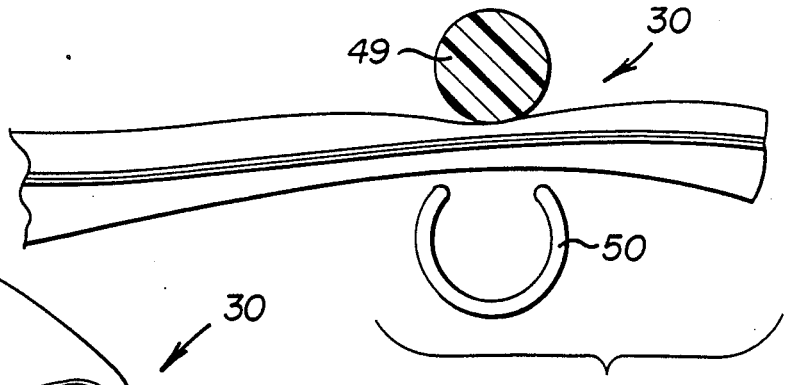
FIGURE 15
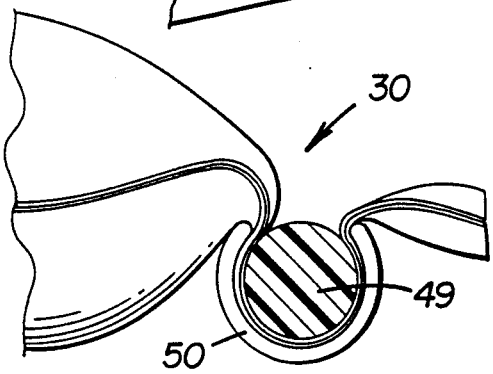
FIGURE 16
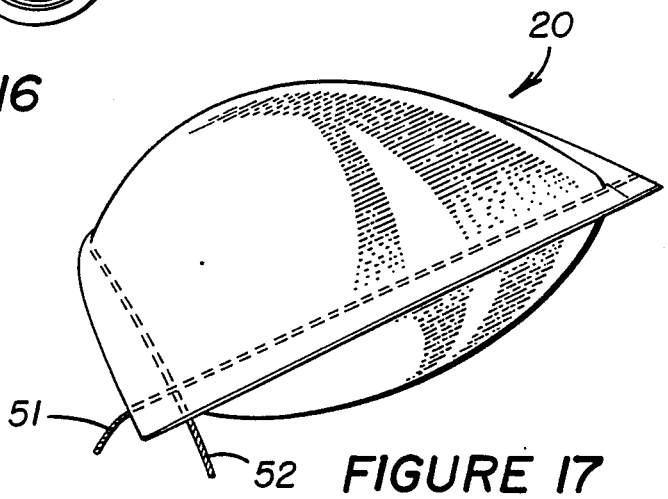
FIGURE 17
FIGURE 18
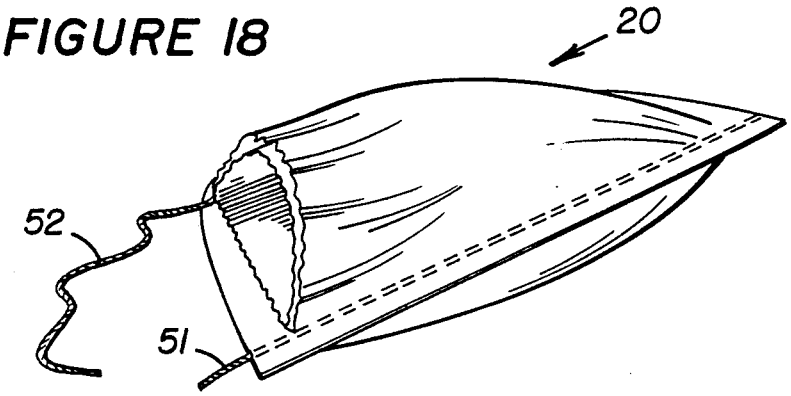

METHOD FOR FORMING BAG-IN-BAG PACKAGING SYSTEM

CROSS-REFERENCE TO RELATED APPLICATION

This application is a divisional of U.S. patent application Ser. No. 07/089,228, filed on Aug. 25, 1987 for "Bag-in-Bag Packaging System" now U.S. Pat. No. 4,872,558, issued on Oct. 19, 1989.

TECHNICAL FIELD

This invention relates generally to a packaging system and method and more particularly to a package comprising an outer bag having an article-carrying inner bag suspended therein.

BACKGROUND ART

U.S. Pat. No. 4,597,244, issued on July 1, 1986 to Daniel A. Pharo for "Method For Forming An Inflated Wrapping," discloses a packaging system and method wherein an article is packaged within an inflated, sealed bag. The present invention provides certain improvements and variations over the packaging system and method taught in the above patent.

DISCLOSURE OF INVENTION

The improved packaging system of this invention comprises an outer bag defining a sealed chamber, an inner bag disposed within the chamber and having at least opposite peripheral edges thereof secured to the outer bag to suspend the inner bag within the chamber, and means at least substantially filling the chamber with a filler medium to substantially encapsulate and support the inner bag within the outer bag. The inner bag defines an article-receiving pocket therein whereby the article is also supported and maintained in out-of-contact relationship relative to surrounding walls of the outer bag.

In carrying forth the method of this invention, peripheral edges of the inner bag are secured to the outer bag to suspend the inner bag within the chamber of the outer bag, an article is placed through an open side of the inner bag and in the pocket defined within the inner bag, the open sides of the bags are sealed, the chamber is at least substantially filled with the filler medium to susbstantially encapsulate and support the article at a fixed position within the chamber and the chamber is sealed.

BRIEF DESCRIPTION OF THE DRAWINGS

Other objects and advantages of this invention will become apparent from the following description and accompanying drawings wherein:

FIG. 4. is an isometric view illustrating insertion of an article into an open end of the inner bag;

FIG. 5 is an isometric view illustrating means for inflating the outer bag with a pressurized fluid, such as air;

FIG. 6 is an enlarged sectional view, taken in the direction of arrows VI—VI in FIG. 5, illustrating the ingress of the pressurized fluid into the outer bag;

FIG. 7 is an enlarged top plan view of a filling stem after it has been sealed, subsequent to inflation of the outer bag;

FIG. 8 is an isometric view, partially illustrating a modified packaging system;

FIG. 9 is a cross-sectional view illustrating inflation of an outer bag of the modified packaging system of FIG. 8;

FIGS. 10–16 illustrate alternative end closures for the packaging system; and FIGS. 17 and 18 illustrate an opening device for the packaging system.

BEST MODE OF CARRYING OUT THE INVENTION

Figure 1:
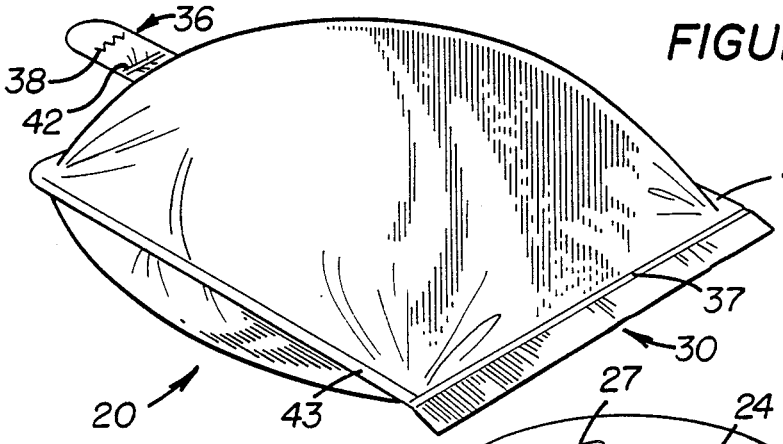
FIG. 1 is an isometric view illustrating a packaging system embodying this invention.
Figure 2:
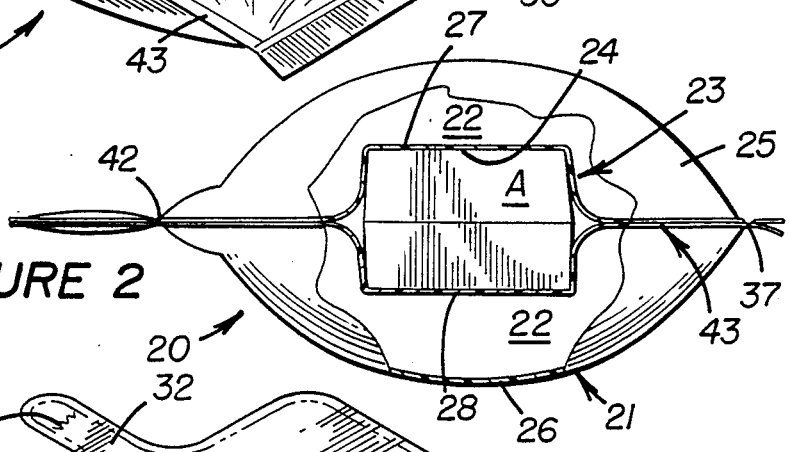
FIG. 2 is a side elevational view of the packaging system with a sidewall portion of an outer bag thereof being removed to illustrate an article-retaining inner bag disposed in suspended and supported relationship within the outer bag.
Figure 3:
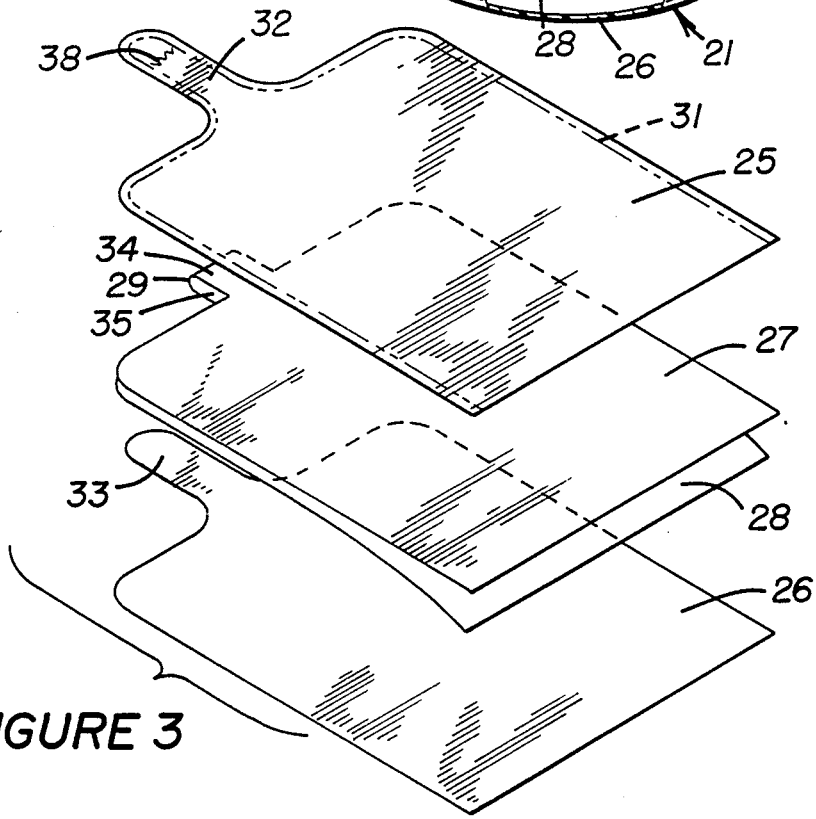
FIG. 3 is an exploded isometric view illustrating cut panels utilized to form a package from the inner and outer bags.

FIGS. 1 and 2 illustrate a packaging system 20 comprising an outer bag 21 defining an inflatable, sealed chamber 22 therein. An inner bag 23, defining a pocket 24 for retaining an article A therein, is disposed within split chamber 22 and has peripheral edges thereof secured to the outer bag, in a manner hereinafter fully described, to support and suspend the inner bag within the chamber. As illustrated in FIG. 3, outer bag 21 comprises a pair of superimposed and identical panels 25 and 26 whereas inner bag 23 comprises a pair of superimposed panels 27 and 28 connected together at a fold 29.

Each panel 25–28 is preferably composed of a gas-impervious composite laminate, such as the type described in U.S. Pat. No. 4,597,244. For example, each flexible panel may comprise an intermediate layer of aluminum and outer and inner layers of a plastic heat-sealable coating, such as polyethylene, adapted to reactivate (melt) in the range of 300° F. These types of composite laminates (which may be constructed to be highly flexible and inextensible or extensible) are well known in the art and, therefore, further description thereof is unnecessary for a full understanding of this invention. In the embodiment illustrated, the panels of FIG. 3 are heat-sealed together at selected overlying peripheral edges thereof to preform a package for the packaging system with a closeable end closure 30, illustrated in its open condition in FIG. 4.

FIG. 3 illustrates overlying common sealing areas peripheral edge portions of the panels by dot-dash lines 31 for explanation and clarification purposes. The panels may be suitably cut and sealed together by conventional apparatus and methods, such as those described in U.S. Pat. No. 4,545,844. It should be noted in FIGS. 1–4 that stem portions 32 and 33, formed integrally with and extending outwardly from edges of panels 25 and 26, respectively, are heat-sealed together about their edges. These stem portions are further heat-sealed to underlying parallel side edges of panel portions 34 and 35 of panels 27 and 28, respectively, which are joined together at fold 29.

Fold 29 and the remaining portions of panel portions 34 and 35, extending transversely between the superimposed and sealed edges of panel portions 31–34, remain unsealed relative to stem portions 32 and 33. As shown in FIG. 6, fold 29 extends a limited distance into a filling stem 36, defined by overlying and sealed stem portions 31 and 32. As described more fully hereinafter, a pair of inlet passages or passage means are thus formed at fold 29 to communicate a pressurized fluid, such as air, to the two chamber portions constituting split chamber 22 on either side of inner bag 23.

A method for packaging article A to form packaging system 20 and to suspend the article at a fixed position within chamber 22 of outer bag 21, as shown in FIG. 2, will now be described with particular reference to FIGS. 4–7. After the package has been prefabricated to assume its open-ended envelope-like configuration illustrated in FIG. 4, article A is inserted through the open end of inner bag 23 and into pocket 24. It should be understood that the article could be placed at any desired position within the inner bag and will be firmly held in such position when the packaging system is inflated or otherwise charged or filled with the preselected filler medium, as described hereinafter.

After the article has been placed within pocket 24 of inner bag 23, overlying edge portions of formerly open end 30 are heat-sealed together at a seam 37, as illustrated in FIG. 5, to form an end closure. The sealing apparatus used for this purpose may be of the type described in U.S. Pat. No. 4,597,244, such as the impulse table top bag sealer Model 210-8 manufactured by A. I. N. Plastics, Inc. of Mount Vernon, N.Y. Sealing of the open end of the package will thus fully seal pocket 24 of inner bag 23 and will also substantially seal chamber 22.

Inflating means for charging and at least substantially filling chamber 22 with a pressurized fluid is shown in the form of an opening uncovered by a tab 38 defined by a cut line formed only through stem portion 32. An inlet passage 39 to the chamber is defined within filling stem 36 (FIG. 6) to communicate with separate passages defined on either side of fold line 29 and thus with split chamber portions 22, 22. Alternatively, the inflating means for charging chamber 22 could comprise an inflation valve, such as the one disclosed in U.S. Pat. No. 4,586,910 and illustrated at 40 in FIG. 8.

After the open end of the package has been sealed at seam 37, a standard inflation apparatus, including a fill tube 41 (FIG. 5), can be utilized to charge and pressurize split chamber 22 to an inflation pressure exceeding ambient pressure, e.g., exceeding 14.7 psi at sea level. Alternatively, human lung power could be utilized to inflate chamber 22 with air. Other types of gases, such as helium, could be utilized as the filler medium, as well as a suitable liquid, such as water. Alternatively or in addition to the pressurized fluid, the chamber could be filled with a plastic (e.g., urethane, polystyrene, etc.) material in solid (injected in liquid form and solidified) or pieces (e.g., balls or pellets) form.

After the package has been inflated to suspend inner bag 23 and article A at its preselected fixed position within chamber 22, fill tube 41 is removed. Tab 38 is simultaneously compressed into stem 36 to prevent the pressurized fluid from escaping. As shown in FIG. 7, stem 36 is then quickly heat-sealed at a seam 42 (sealing only stem portions 32 and 33 together) and/or at a seam 42′ (sealing stem portions 32 and 33 and panel portions 34 and 35 together).

Referring to FIG. 2, article A is thus substantially encapsulated by the filler medium and supported and held at a fixed position within chamber 22. Compressive forces occasioned by the pressurized fluid will be directed inwardly and uniformly against the exposed upper and lower surfaces of inner bag 23 to compress and conform the flexible wall panels of the inner bag to the contours of the article. Retention of the article in a fixed position within split chamber 22 is further aided by the horizontal components of forces acting on inner surface portions of transversely disposed side seams 43 and 43′ of outer bag 21.

The latter holding force desiderata is more clearly illustrated and pronounced in modified packaging system 20′ (FIGS. 8 and 9) wherein horizontal force components F will tend to place panels 27 and 28 of the inner bag in tension. In order to increase the horizontal force components F in this manner, outer bag panels 25 and 26 are prefabricated to have widths greater than the widths of panels 27 and 28 (FIG. 8).

FIGS. 10–16 illustrate alternative end closures for packaging system 22 that can be used in lieu of heat sealed seam 37 (FIG. 1).

FIG. 10 illustrates an end closure wherein panels 25–28 are cut to different lengths to define relatively longitudinally staggered panel edges 25′–28′. A standard tape 44 is heat-sealed or mechanically secured over the ends of the panels to close and seal chamber 22 and pocket 24.

FIGS. 11 and 12 illustrate an end closure comprising a standard tape 45 that is folded over the end of the package and then heat-sealed or mechanically sealed in a conventional manner thereover. As noted in FIG. 12, the opposite ends of the tape are then folded inwardly towards each other and secured in place.

FIG. 13 illustrates an end closure wherein a standard tape 47 is secured to the outer side of panel 25 and a protective strip 47 is removed from the tape after article A (FIG. 4) has been inserted into inner bag 23. The panels of the bags can then be folded on a preformed crease or fold line 48, in the manner illustrated in FIG. 14, to secure the panels together. If so desired, the end edges of the panels can be staggered longitudinally in the manner described above in reference to FIG. 10.

FIGS. 15 and 16 illustrate an end closure wherein an elongated rod 49 is pressed-fitted and clamped within a generally C-shaped retainer 50. The rod may be sufficiently elastic to be compressed into the cavity of a semi-rigid retainer and expand, as illustrated in FIG. 16, to firmly compress the panels of the end closure therebetween to again seal and isolate chamber 22 and pocket 24 (FIG. 2). Alternatively, rod 49 could be composed of a semi-rigid plastic material with retainer 50 also being composed of a plastic material, but exhibiting sufficient flexure to spread and permit the rod to snap-fit or press-fit within the retainer in a well known manner.

Various opening devices and constructions can be utilized and formed into the end closure to open packaging system 20. For example, FIGS. 17 and 18 illustrate a cord or thread 51 that is implanted in the heat-sealed end closure to adapt it for removal by a consumer. As an alternative or in addition to cord 51, a second cord 52 can be likewise implanted adjacent to heat-sealed side seam 43 or 43′ to permit its removal and opening of the packaging system, as illustrated in FIG. 18. The cords may be suitably secured within the underside of one of the panels forming inner pouch 23 whereby article A (FIG. 2) will be exposed when the cord is removed.

Various modifications can be made to the preformed package and completed packaging system of this invention without departing from the spirit and scope thereof. For example, panels 27 and 28 of inner bag 23 could comprise an open mesh or fishnet material to expose article A (FIG. 2) to the filler medium contained in chamber 22. The package could also include additional bags, secured to bags 23 and 25 in the manner described above. Instead of using distal end 30 of packaging system 20 as the open side thereof, this end of the system could be heat-sealed during prefabrication of the package and one of the lateral sides left open and utilized for packaging purposes in the manner described above. Stem 36 could be eliminated and inflating means 38 or 40 relocated on the package (e.g., valve 40' could be secured on panel 25 as shown in FIG. 8).

The heat-sealed seams of the system could be formed in the manner described above, or the panels folded onto each other and then heat-sealed together to form a seam having eight plies, for example. Gussetted seams could also be employed with the corners of end closure being folded inwardly towards each other and heat-sealed in place. In addition to the above described end closures, the end portions of the panels comprising the end closure could have encapsulated beads of glue formed thereon which would function to adhere and seal the panels together when pressure and/or heat is applied to the panels to rupture the beads of glue. These portions of the panels could also be multi-folded over each other and then heat-sealed or reverse folded onto each other and then heat-sealed.

I claim:

1. A method for packaging an article comprising the steps of securing opposite peripheral edges of an inner bag and an outer bag together to suspend said inner bag within divided chamber portions defined within said outer bag on opposite upper and lower sides of said inner bag to further define an open side, disposed transversely relative to said opposite peripheral edges, on each of said first and second bags, forming a filling stem to define an inlet passage between peripheral and overlying edge portions of said outer bag that communicates with said chamber portions, placing an article through the open side of said of inner bag and within a pocket defined within said inner bag, sealing the open sides of said inner and outer bags, at least substantially filling said chamber portions simultaneously with a filler medium through said filling stem and inlet passage to substantially encapsulate and support said inner bag and said article at a preselected fixed position within said chamber portions, and sealing chamber portions.

2. The method of claim 1 wherein said outer bag comprises a pair of overlying and generally rectangular first panels, said inner bag comprises a pair of overlying and generally rectangular second panels and said securing step comprises securing overlying peripheral edges, including said opposite peripheral edges, of said inner and outer bags together, except at the open sides thereof and at said inlet passage.

3. The method of claim 2 further comprising forming said filling stem on said outer bag and wherein said filling step comprises filling said chamber with a pressurized fluid through the inlet passage which is defined in said stem.

4. The method of claim 3 wherein said forming step comprises folding panel portions of said second panels to form a fold line and disposing and sealing said fold line within said inlet passage to divide said inlet passage into separate passages each communicating with one of said divided chamber portions.

5. The method of claim 2 further comprising forming said first panels to have widths between the opposite peripheral edges thereof greater than the corresponding widths of said second panels.

6. A method for forming a package comprising the steps of forming an outer bag, defining an inflatable chamber, from a pair of overlying first panels having overlying stem portions defining an inlet passage therebetween communicating with said chamber, forming an inner bag, defining a pocket adapted to retain an article therein, from a pair of overlying second panels having overlying and folded panel portions defining a fold line, positioning the fold line defined by the overlying and folded panel portions of said second panels within the inlet passage defined by the overlying stem portions of said first panels to divide said inlet passage into separate passages, and securing peripheral edges of said outer and inner bags together, except at said stem portions, to suspend said inner bag within said outer bag and to split said chamber into first and second chamber portions on opposite sides of said inner bag so that each of said first and second chamber portions communicates with a respective one of the separate passages of said inlet passage.

* * * * *